United States Patent [19]

McAnelly

[11] Patent Number: 4,747,347

[45] Date of Patent: May 31, 1988

[54] APPARATUS FOR PROCESSING CONTINUOUS FORM

[75] Inventor: Jan A. McAnelly, West Linn, Oreg.

[73] Assignee: Continuous Graphics, Inc., West Linn, Oreg.

[21] Appl. No.: 77,022

[22] Filed: Jun. 29, 1987

Related U.S. Application Data

[63] Continuation of Ser. No. 801,733, Nov. 26, 1985, abandoned, which is a continuation-in-part of Ser. No. 749,313, Jun. 26, 1985, abandoned.

[51] Int. Cl.[4] ..... B41F 13/04; B41F 13/54

[52] U.S. Cl. ..... 101/227; 101/228

[58] Field of Search ..... 101/228, 232, 178, 181, 101/219, 217, 218, 137, 142, 143, 144, 224–227; 226/74, 43, 155

[56] References Cited

U.S. PATENT DOCUMENTS

| | | | |
|---|---|---|---|
| 1,459,312 | 4/1923 | Pritchard . | |
| 2,149,028 | 2/1939 | Meisel | 101/181 |
| 2,270,273 | 1/1942 | Davidson | 101/142 |
| 2,671,397 | 3/1954 | Gorbatenko | 101/228 |
| 2,782,719 | 2/1957 | Claff | 101/144 |
| 2,967,479 | 1/1961 | George et al. | 101/228 |
| 3,373,684 | 3/1968 | Fisher | 101/228 |
| 3,585,931 | 6/1971 | West | 101/228 |
| 4,057,014 | 11/1977 | Thomas | 101/228 |

FOREIGN PATENT DOCUMENTS 111078 of 1918 United Kingdom .

*Primary Examiner*—J. Reed Fisher

*Attorney, Agent, or Firm*—Chernoff, Vilhauer, McClung & Stenzel

[57] ABSTRACT

An attachment for an offset press, of the type adapted to process individual sheets of paper, to enable it to feed and print continuous form in proper registery. In one embodiment the invention includes a paper feeding station downstream of the press and a separate registration station upstream of the press. The paper feeding station employs an adjustable rotating circumferential segment, driven off the press, cooperating with a draw roller to intermittently engage the continuous form paper, draw a predetermined increment through the press and then disengage from the paper. In another embodiment the paper feeding function is accomplished by the printing blanket which discontinuously engages the paper and feeds it through the press in predetermined increments thereafter disengaging from the paper after each of the increments is fed. In both embodiments the registration station maintains continuous engagement with the paper by means of a freely rotatable, endless pin belt which engages the pin holes of the paper and individually registers each increment of paper to the press while the paper is disengaged by the paper feeder. A rotating disc, operatively connected to the pin belt, includes a plurality of windows for receiving a solenoid activated, wedge-shaped finger which arrests and positions the disc and paper in one of a plurality of predetermined positions. A sensor associated with the paper feeder detects when the paper is engaged or disengaged and generates a signal to the solenoid.

14 Claims, 4 Drawing Sheets

FIG. 3
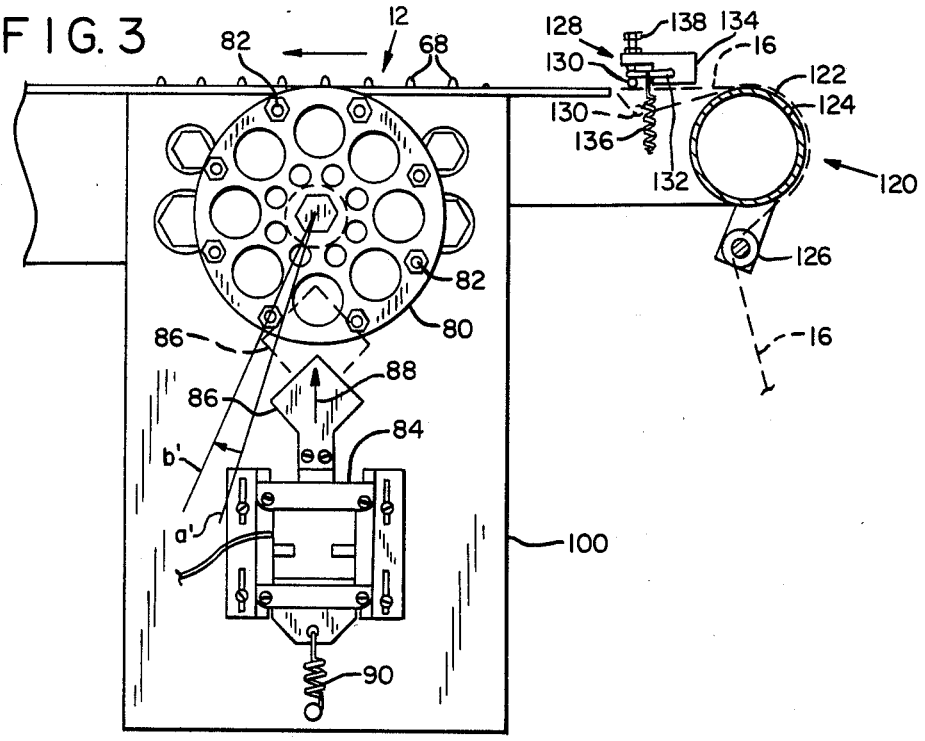
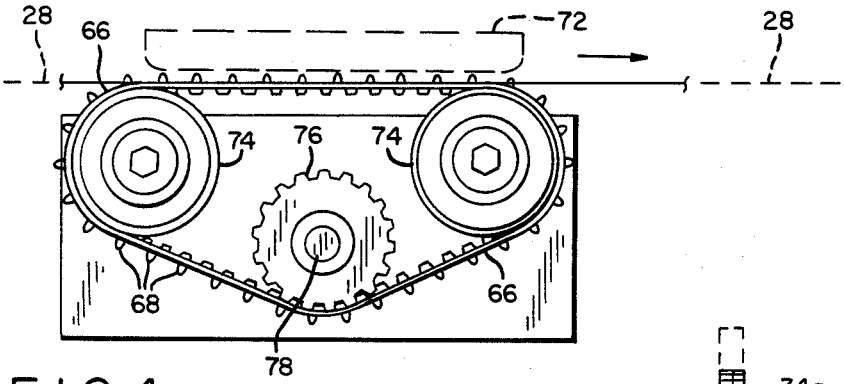
FIG. 4
FIG. 7
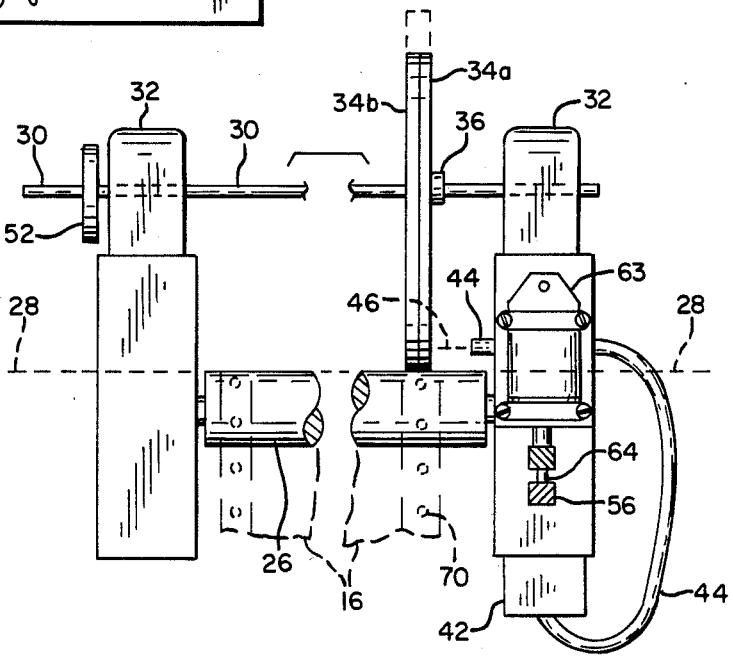

APPARATUS FOR PROCESSING CONTINUOUS FORM

RELATIONSHIP TO OTHER APPLICATION

This application is a continuation of application Ser. No. 801,733, filed Nov. 26, 1985, now abandoned, which is a continuation-in-part of application Ser. No. 749,313 now abandoned, entitled "Method and Apparatus for Feeding and Registering Continuous Form" filed June 26, 1985 by Jan A. McAnelly.

BACKGROUND OF THE INVENTION

This invention relates to a method and apparatus for feeding and registering continuous form paper to a processing unit such an offset press and to a method and apparatus for adapting a processing unit such as an offset press, originally adapted to process single sheets of paper, to process continuous form paper.

The arrival of the word processors and high speed, computer controlled printers in modern offices and businesses have created a need for a variety of business documents, such as invoices, purchaser orders, letterhead, envelopes, checks, and the like to be available on continuous form paper so they may be rapidly processed by the high speed office printer. One method of providing such a capability is to mount the business documents such as letterhead or invoices onto continuous carrier paper. This involves several processes, first the business document must be printed, and second it must be mounted on the carrier paper precisely aligned and registered so that the high speed office printer, which is referenced to the carrier paper through the pin holes on the margins of the carrier paper, will know where to print and where to not print. Expensive, relatively slow machines are needed to mount the documents on the carrier paper in precise registry.

Another method is to print the business documents such as letterhead or invoices directly onto the continuous form paper and then, through the use of perforations in the continuous form paper, separate the printed documents from the marginal strips having the pin holes therein and from the adjacent printed documents. This process is preferable to the carrier mounted method since it eliminates a step and an expensive machine, but it has the same requirement for precise registry. The printing on the continuous form must be precisely placed with respect to the perforations which define the separate documents within the continuous form paper. Lack of proper registration can cause printing to run over the perforations extending across the continuous form paper which define the separate documents.

Printing on continuous form raises another problem, especially in the case of letterhead which should have an "clean edge" appearance and not display detectable serrations on the edges. While perforation methods and apparatus are available which can achieve such a clean edge appearance when the individual sheets of letterhead are broken out of the continuous form, such clean edge perforations are very delicate and prone to breaking during processing.

This then defines the problem, to feed and precisely register continuous form paper to a press or other processing unit without breaking the perforations, even clean edge perforations.

Most of the existing machines for processing continuous form paper use a "tractor feed" device, a system of multiple driven pin wheels or pin belts which engage the pin holes on the margins of the continuous form paper and pull the paper through the processor. Similarly, most of these machines also use the tractor feed mechanism to index or register the continuous form paper to the press or processor. In many processors, such as offset presses and perforators, it is necessary to stop, retard, or advance the passage of paper through the processor to keep the paper in proper registry with the printing or perforating cylinder.

Several disadvantages associated with this type of system are that each of the tractor feed drives on a particular unit must be synchronized and timed with respect to each other and to the processing unit, and that any imprecision in the feeding system is carried over into the registration system. Thus small errors can, with sufficient iterations, accumulate into large errors. Furthermore, the stopping, starting, retarding and advancing of the multiple tractor feed devices, all of which engage the paper, has a tendancy to distort or rip the pin holes, or break the perforations, especially clean edge types of perforations.

SUMMARY OF THE INVENTION

Applicant has overcome these disadvantages in the prior art by not using a tractor feed system, employing separate, and substantially independent, feed and registration systems, and by disengaging the paper feeder from the paper so that a low mass, low inertia registration system can successively index each document within the continuous form paper to the processing unit without stressing, distorting or breaking the pin holes or perforations in the continuous form paper.

The apparatus for feeding and registering continuous paper to a processing unit according to the present invention includes a paper feeder adapted to feed predetermined increments of continuous paper to the processing unit in discontinuous pulses, the paper feeder disengaging from the paper after each predetermined increment of paper has been fed through the processing unit so that the paper is movable with respect to the paper feeder, and also includes a registration device, separate from the paper feeder, for successively indexing the paper to the processing unit each time the paper feeder disengages from the paper.

The method according to the present invention includes discontinuously engaging the continuous paper with a paper feeder and feeding predetermined incremental lengths of the paper through the processing unit, disengaging the paper feeder from the paper after each incremental length has been fed through the processing unit, maintaining continuous engagement with the paper separately from the paper feeder, positioning and holding the paper in a predetermined position with respect to the processing unit while the paper is disengaged by the paper feeder, and permitting the paper to move with respect to the processing unit when the paper is re-engaged by the paper feeder.

Accordingly, it is a primary objective of the present invention to provide a method and apparatus for feeding and registering continuous form paper to a processing unit.

It is an accompanying objective of the present invention to provide a method and apparatus for feeding and registering continuous form to a processing unit of the type adapted to process single sheets of paper.

It is an associated objective of the present invention to provide an attachment for an offset press, of the type adapted to process single sheets of paper, to enable the press to print continuous form paper, which attachment may be attached and detached from the press without substantial effort or modification.

It is another object of the present invention to provide an apparatus for feeding and registering continuous form to a processing unit wherein the feeding and registering portion of the apparatus are substantially separate and independent from each other.

It is a further objective of the present invention to provide such an apparatus wherein the paper feeder intermittently disengages from the paper.

It is a further objective of the present invention to provide such an apparatus wherein the paper is indexed to the processing unit and the paper feeder while the paper is disengaged from the paper feeder and processing unit.

It is another object of the present invention to provide such an apparatus with a novel mechanical registration system.

The foregoing and other objectives, features, and advantages of the invention will be more readily understood upon consideration of the following detailed description of the invention, taken in conjunction with the accompanying drawings.

BRIEF DESCRIPTION OF THE DRAWINGS

FIG. 3 is an elevational view of the registration portion of the invention.

FIG. 4 is an elevational view of the registration portion of the invention taken along lines 4—4 of FIG. 2.

FIG. 7 is an end elevational view of the paper feeding portion of the first embodiment of the invention taken along lines 7—7 of FIG. 5.

DETAILED DESCRIPTION OF THE INVENTION

Figure 1:
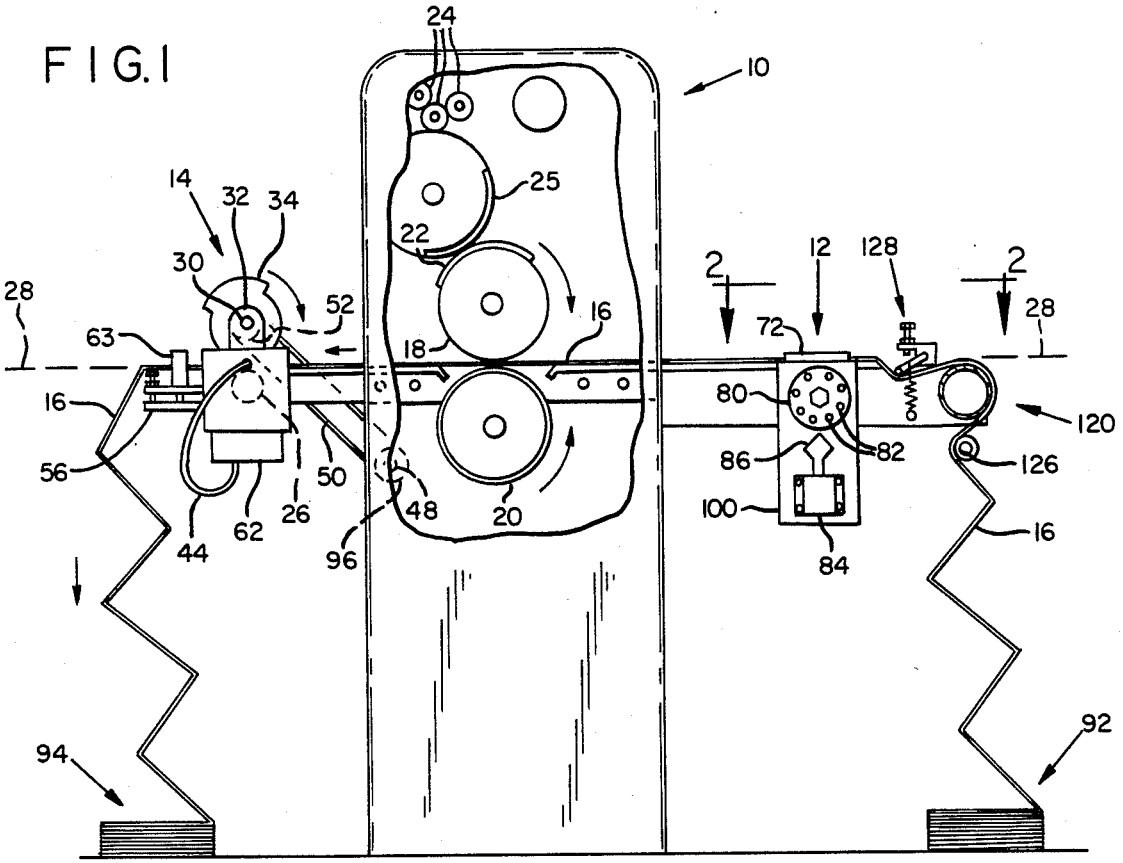
FIG. 1 is a partially schematic elevational view of a first embodiment of the present invention.

The method and apparatus of the present invention is shown in the drawings and described herein in conjunction with an offset printing press of the type adapted to process individual sheets of paper. One embodiment employs a modified printing blanket assembly as a paper feeder while another embodiment adds a separate paper feeder to the offset press. However, it should be understood that the features and principles described herein apply equally to other processing units whether adapted to process single sheets or continuous form paper.

Turning to FIG. 1, a first embodiment of the apparatus of the present invention is shown in conjunction with an offset printing press 10 adapted to print individual sheets of paper, and includes a registration station 12, upstream of the press, and a paper feeding station 14 downstream of the press so that the continuous form paper 16 is pulled past the registration station and through the press by the paper feeder.

The press includes a blanket cylinder 18 and a parallel opposed impression cylinder 20 which rotate at the same speed. The blanket cylinder and impression cylinder are arranged so that there is a small space (approximately 0.033 inch) between them. The blanket cylinder mounts a printing blanket 22 whose thickness (0.035 inch) exceeds the space between the cylinders. The printing blanket contains the image to be printed on to the paper. An assembly of ink rollers 24 spread ink and water onto a plate cylinder 25 which transfers the image to be printed onto the printing blanket. It should be noted that the blanket cylinder and impression cylinder are arranged and rotated so that when the blanket becomes opposed to the impression cylinder the combined rotation of the two cylinders will pull paper through the press, but when the blanket is not opposed to the impression cylinder, the paper, being thinner (0.004 inch) than the space between the cylinders, will not be acted upon by the press.

Referring to FIGS. 1, 5, 6 and 7, the paper feeding station 14 according to a first embodiment of the present invention includes a draw roller 26 arranged perpendicular to the paper flow and directly below the paper plane 28, as defined by the path of the paper as it passes through the offset press. The draw roller is mounted on a shaft journaled in bearings 54 at either end for free rotation. A feeder shaft 30 is journaled directly above and parallel to the draw roller by a pair of feeder shaft bearings 32. Mounted on the feeder shaft for rotation therewith is an adjustable segment 34 comprising two adjacent, concentric, circumferential segments **34*a* and 34*b*. One of the segments 34*a* is fixed to the shaft by a collar 36 while the other segment 34*b* may be free to rotate about the feeder shaft with respect to the fixed segment. As may be seen in FIG. 6, each of the segments includes a plurality of adjustment holes 38 which may be employed to fix the segments together with a bolt 40 or other suitable fastening device in a desired rotational relationship to each other. It should be apparent that by selective use of the bolt and adjustment holes the circumferential length of the segment may be adjusted as desired. The holes 38 shown in FIG. 6** allow configuration of the segments in any one of a plurality of predetermined circumferential lengths. Employing slots instead of holes would permit any circumferential length within the range of the two segments.

A retro-reflective photoelectric scanner 42 such as manufactured by Banner Engineering Corporation of Minneapolis, Minn. is mounted to the apparatus near the feeder portion. A fiberoptics device having a bifurcated fiber 44 adapted to be used with a retroreflective scanner leads from the scanner to a position near one of the feeder shaft bearings and is aligned so that the beam path 46 of the fiber 44 is within a plane defined by the axis by the feeder shaft and the draw roller. As may be seen in FIGS. 6 and 7, the fiber is positioned so that the beam will only strike the segment **34*a* or 34*b*** when the segment is in contact with the draw roller.

As previously mentioned, the draw roller is freely rotatable. However, the feeder shaft is operatively connected to a drive shaft 48 on the press by a belt 50 and pulley 52 mounted on the feeder shaft in a manner shown in FIGS. 1, 6 and 7. The drive shaft is operatively connected to the shaft that turns the blanket cylinder and the impression cylinder so that the blanket cylinder, impression cylinder and feeder shaft all turn at the same rate.

Figure 6:
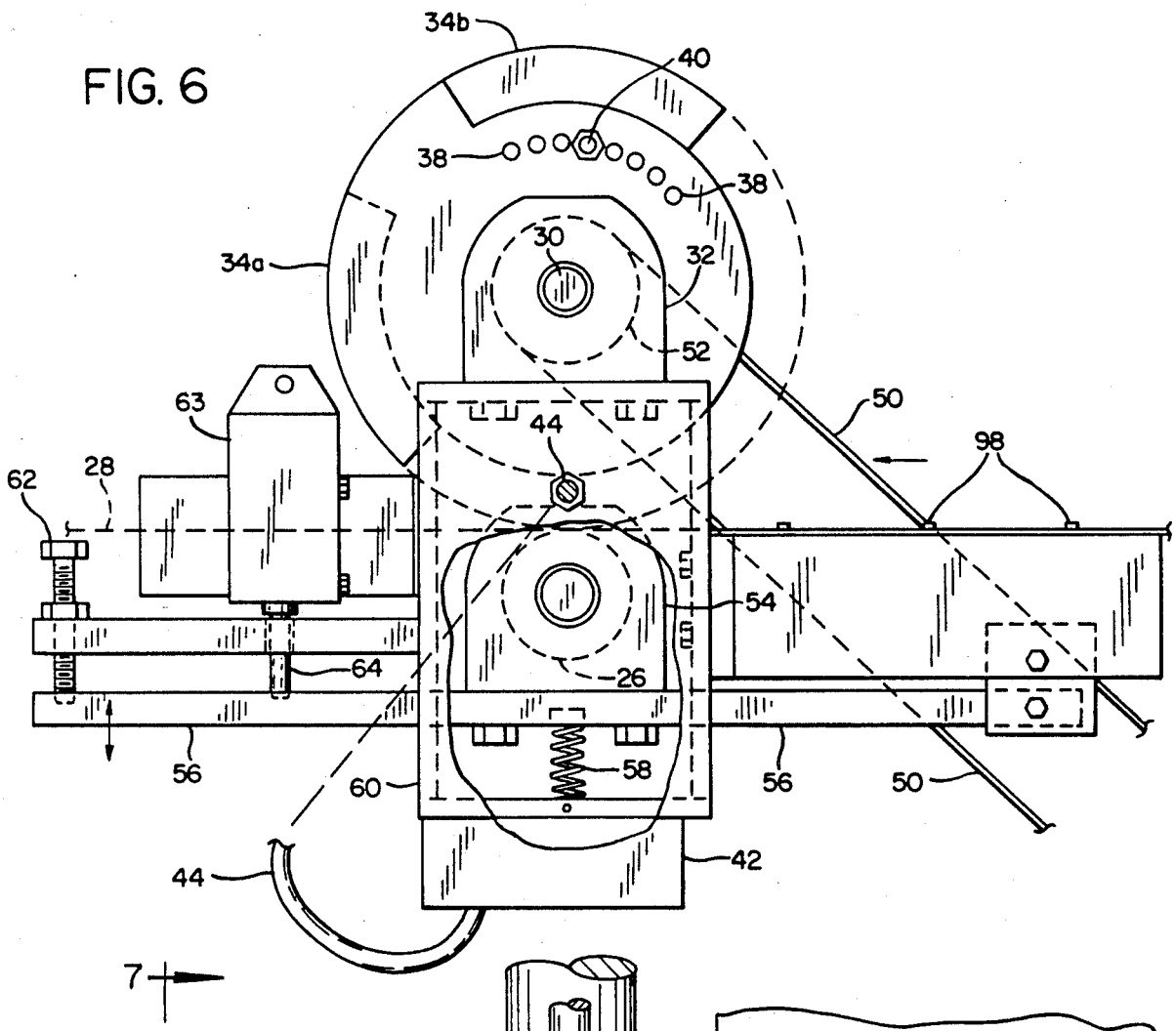
FIG. 6 is a partially cut away elevational view of the paper feeding portion of the first embodiment shown in FIG. 1.

Turning to FIG. 6 it can be seen that the draw roller bearings 54 which journal the draw roller are mounted to an arm 56 which is pivotally hinged to the main structure of the apparatus. The arm is supported by a biasing spring 58 mounted to a side plate 60 which is integrally attached to the main structure of the press. The height of the draw roller assembly with respect to the main structure may be predetermined and maintained by a set screw 62 so as to set and maintain the pressure between the segment and the draw roller. A draw roller solenoid 63, attached to the main structure with its piston 64 bearing against the arm 56, may be used to selectively disengage the draw roller from the paper plane and the segment by causing the arm carrying the draw roller bearings to pivot down and away from the paper plane.

Figure 2:
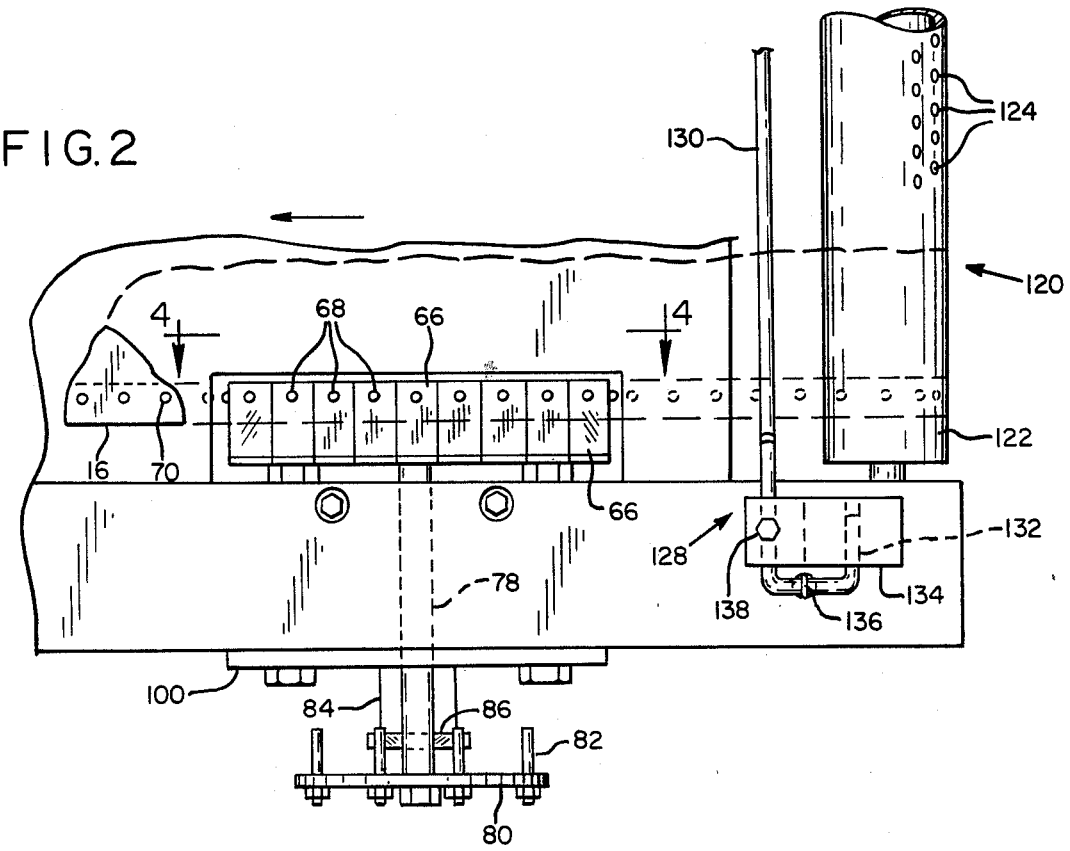
FIG. 2 is a plan view of the registration portion of the invention taken along lines 2—2 of FIG. 1.

Turning now to the registration station of the apparatus shown in FIGS. 1 through 4, with initial reference to FIGS. 2 and 4, an endless pin belt 66 having a plurality of pins 68 thereon is arranged so that a portion of the endless pin belt is co-planar with the paper plane 28 and aligned so as to cooperate with the pin holes 70 along one margin of the continuous form paper 16. A paper guide 72 straddles the pins as they protrude from the paper to ensure that the pins are, and stay, securely seated in the pin holes of the paper.

A pair of upper pulleys 74 position the endless pin belt in the paper plane. The pin belt is also trained over a lower pully 76 which is fixed to an indexing shaft 78. Turning to FIGS. 2 and 3, it may be seen that the indexing shaft has a disc 80 attached thereto for rotation therewith. The disc 80 has a plurality of posts 84 mounted at regular intervals around the circumference thereof. The endless pin belt 68, pulleys 74, 76, indexing shaft 78, disc 80 and posts 84 are all preferably made from strong, durable, yet light material so that the mass and therefore the inertia of the registration assembly is minimized. To this end, the disc, preferably nylon, has a plurality of holes formed therein.

A registration solenoid 84 having a wedgeshaped finger 86 attached to its piston is mounted proximate the disc so that activation of the solenoid causes the wedge-shaped finger to extend within the circumference of the disc contacting the posts and stopping the rotation of the disc. As shown in dashed lines in FIG. 3, the wedge-shaped finger wedges in between two posts, causing the disc to rotate to a position so that the adjacent posts are equidistant from the axis of the wedge-shaped finger, represented by the arrow 88. A return spring 90, fastened to mounting plate 100 and to the finger, serves to retract the finger from engagement with the disc and the posts when the solenoid is energized.

In operation, the segment 34 is adjusted so that the circumferential length of the segments **34*a* and 34*b* added together correspond exactly to the incremental length of the document within the continuous form paper which is to be printed. This may be accomplished by rotating segment 34*b* on the feed shaft with respect to segment 34*a* and locking it into the desired position by means of the holes 38 and bolt 40. Next, the entire segment 34 is aligned to correspond with the position of the blanket 22 on the blanket cylinder as shown in FIG. 1. This may be done by unlocking the collar 36 on segment 34*a* and rotating the segment on the feed shaft, or by slackening the drive belt 50 and rotating the feed shaft. Continuous form paper is fed from the infeed pack 92, shown in FIG. 1, through the registration station where it is engaged with the pins of the endless pin belt, through the press, between the blanket cylinder and the impression cylinder, and through the paper feeder, over the draw roller and under the segment, to the outfeed pack 94, also shown in FIG. 1**.

When the apparatus is operated, the blanket cylinder, impression cylinder and feeder shaft turn at the same rate and the segment and blanket engage the paper substantially simultaneously. Although the blanket cooperates with the impression cylinder to help draw the continuous paper through the press, in the first embodiment of the invention shown in FIG. 1 it is the segment, in cooperation with the draw roller, which is primarily responsible for the feeding function. As may be seen in FIGS. 2 and 7, the segment grips the paper between itself and the draw roller, and as the segment rotates about the feeder shaft the draw roller is rotated and paper is drawn through the apparatus. After exactly one increment of paper corresponding to the length of the document to be printed has been drawn through the press, the segment disengages from the paper at approximately the same time that the blanket disengages from the paper. In the first embodiment the printing blanket is usually shorter than the incremental length of paper to be printed so that the blanket will usually engage the paper after, and/or disengage from the paper before, the segment.

The fiberoptics fiber 44 is arranged in a plane defined by the axis of the feeder shaft and the axis of the draw roll, so that when the segment disengages from the paper and draw roll, the reflective receiving fiber will sense the loss of a reflective signal caused by the beam 46 bouncing off the segment. In this way the scanner may immediately generate a signal when one increment of paper has been drawn through the machine. This signal is sent to the registration solenoid and causes the wedge-shaped finger to extend within the circumference of the disc. Similarly, when the segment rotates back into the beam of the reflective receiving fiber, the scanner will generate a signal to de-energize the registration solenoid and the finger will be pulled out of contact with the disc by the spring.

As may be understood with reference to FIG. 3, as the wedge-shaped finger protrudes into the rotating disc, the point of the finger will enter into a "window" defined by the adjacent posts. As the finger thrusts into complete engagement with the posts, the wedge shape of the finger will cause the disc to rotate, either forward or backward, so that the adjacent posts are equidistance from the axis 88 of the finger. In this way the disc is arrested and positioned in one of a number of predetermined positions, each predetermined position defined as the mid-point of the window between adjacent posts. Since the disc is linked to the endless pin belt which engages the pinholes of the paper, the paper will be positioned in one of a number of predetermined positions. Recall that when the registration solenoid is fired, the blanket and the segment have just disengaged from the paper and the paper may be freely moved forward or backward by the disc and pin belt of the registration station.

It will be readily understood that one of the advantageous features of the present invention is that reiterative indexing of the continuous form paper with respect to the processing unit after each document is printed prevents cumulative error. It should also be pointed out that the registration is very precise due to the interaction of the wedge-shaped finger and the posts, and that the "window" concept allows for a large margin of error in generating the signal to the registration solenoid. For example, the window in the exemplary embodiment represents one-half inch of paper travel, so the signal from the scanner may be in error by as much as one-quarter inch of paper travel, yet the paper will be reindexed to within 0.062 inches.

Comprehension may be assisted by the provision of an example. To print 11 inch letterhead with the present invention, the segment would be adjusted so that the circumferential length of the segment was exactly 11 inches. The blanket needed to print the letterhead would be something less than 11 inches, perhaps as little as two or three inches if the letterhead only bears printing at the top. The segment and blanket would be aligned so that the segment was sufficiently rotationally advanced with respect to the blanket to properly place the printing on the document, for example 1 inch beloW the top of the document. Next the pre-perforated paper would be fed to the apparatus, engaged on the pin belt of the registration station and aligned with the blanket so that the printing will assume the proper position on the document. When the apparatus is operated, the segment will pull exactly 11 inches of pre-perforated paper through the press, the scanner would detect when the segment disengages from the paper and send a signal to the registration solenoid, which would fire the finger into contact with the disc arresting and precisely positioning the paper with respect to the processing unit and the paper feeder in preparation for another iteration.

Figure 8:
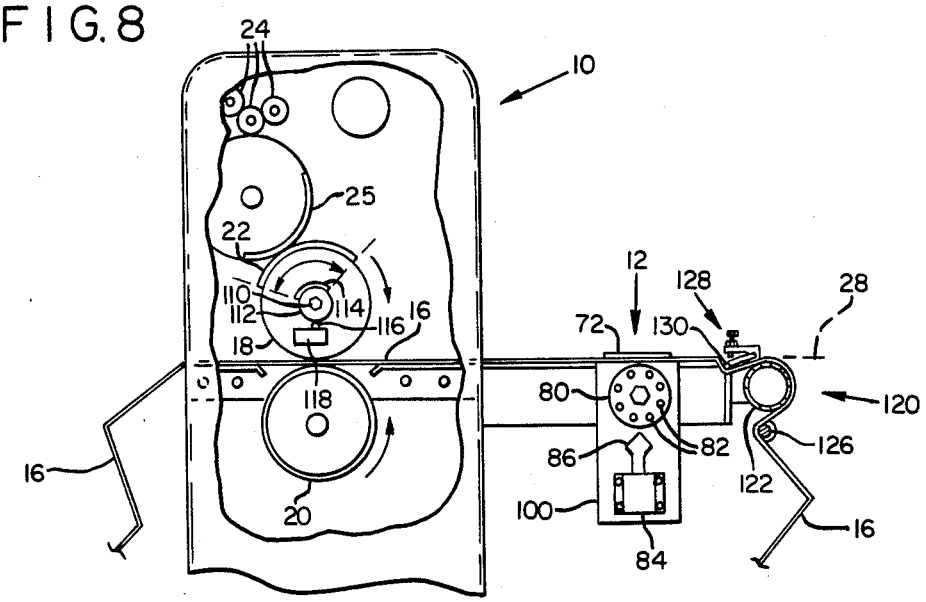
FIG. 8 is a partially schematic view of a second embodiment of the present invention.
Figure 9:
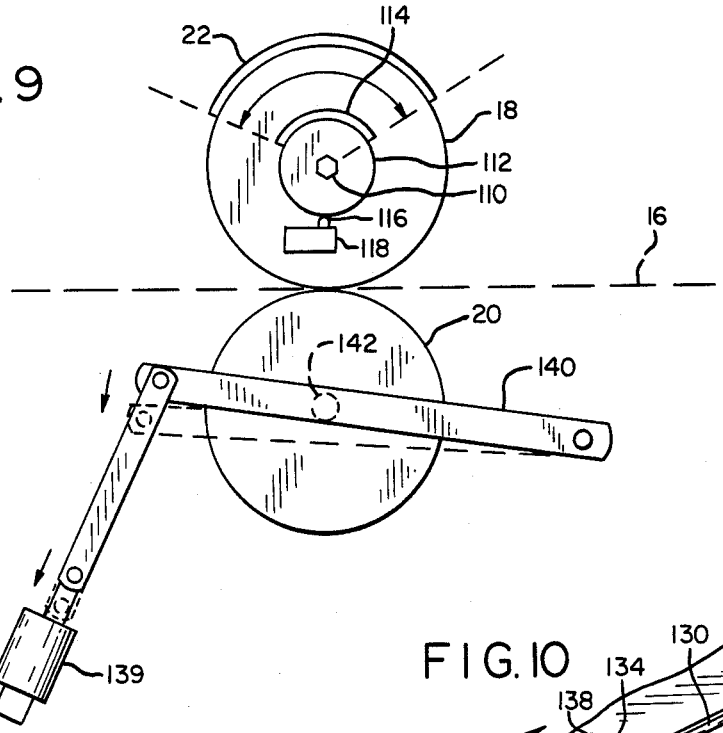
FIG. 9 is a schematic, partial elevational view of the second embodiment shown in FIG. 8 showing the cam and cam follower associated with the paper feeding portion.

A second embodiment of the invention may be seen in FIGS. 8 and 9. As with the first embodiment, the second embodiment is shown in conjunction with an offset printing press 10 adapted to print individual sheets of paper. However, in the second embodiment the paper feeding function is accomplished by the printing blanket 22 and blanket cylinder 18 in cooperation with the opposed impression cylinder 20. The paper 16 is pinched between the rotating blanket and the rotating impression cylinder and drawn through the press at the same time it is being printed by the blanket.

In the second embodiment the printing blanket is sized so that its length, arranged on the blanket cylinder, is equal to the predetermined incremental length of the paper to be printed. As explained previously with respect to the first embodiment, when the printing blanket rotates out of contact with the paper the paper is disengaged from the press and may be moved with respect to the press by the registration station which operates substantially as explained above. Of course it is necessary to provide timely signals to the registration solenoid 84 when the blanket disengages from the paper, and again when it is about to reengage the paper.

With reference to FIGS. 8 and 9, the shaft (not shown) journaling the blanket cylinder is axially tapped and threaded to receive a bolt 110. The bolt is used to fasten a pair of adjacent, concentric, circular plates 112, one plate superimposed upon the other, to the end of the blanket cylinder shaft for rotation therewith. Each plate has a cam 114 formed on the circumference thereof. The nature and function of these cams will be readily understood to be analogous to the circumferential segments 34 of the paper feeder shown in FIGS. 1, 5, 6 and 7 and described above with reference to the first embodiment. Like the circumferential segments, the plates may be rotated with respect to each other and locked in positional relationship by the bolt so that the circumferential length of their combined cams corresponds angularly with the circumferential length of the printing blanket on the blanket cylinder As may be seen in FIGS. 8 and 9, the angular displacement of the cams on the circumference of the plates corresponds to the angular displacement of the printing blanket on the circumference of the blanket cylinder.

A cam follower 116 operatively connected to a microswitch 118 generates a signal to the registration solenoid 84 causing it to de-energize and allow the spring 90 to pull the finger from engagement with the disc 80 when the blanket is about to engage the paper. Similarly, the cam, cam follower, and microswitch provide a signal to the registration solenoid to energize the solenoid and thrust the finger into engagement with the disc, stopping and registering the paper when the blanket disengages from the paper. In operation it is preferable to size the cam so that it has a slightly larger angular displacement than the blanket to ensure that the paper has been released by the registration station prior to engagement by the blanket, and also to ensure that the blanket has disengaged from the paper prior to it being reregistered and immobilized by the registration station.

In FIGS. 8 and 9, the angular displacement of the cam is aligned with the angular displacement of the printing blanket, and the cam follower and microswitch have been positioned at the bottom of the plates 112 to correspond with the position that the blanket will engage the paper. A moments reflection will reveal that the microswitch may be positioned anywhere about the periphery of the plates and that the cam may be rotated out of alignment with the blanket so long as the cam and microswitch are respectively positioned so as to cause the microswitch to generate a signal when the blanket is about to engage the paper and again when it has disengaged from the paper.

Figure 10:
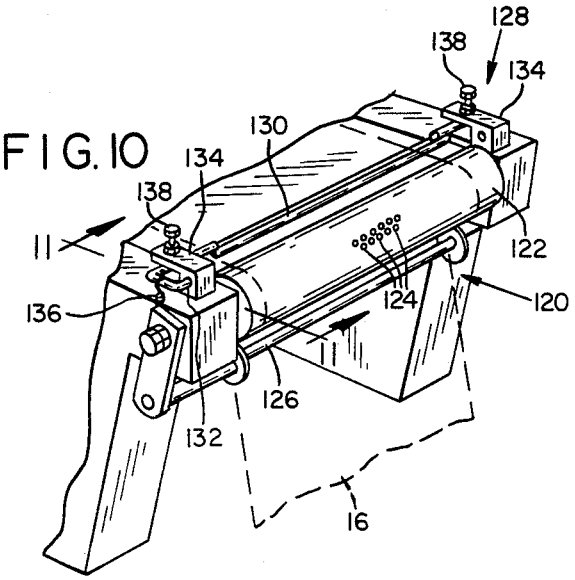
FIG. 10 is a partial view of the infeed portion of an apparatus according to the present invention showing the vacuum brake and dancer.
Figure 11:
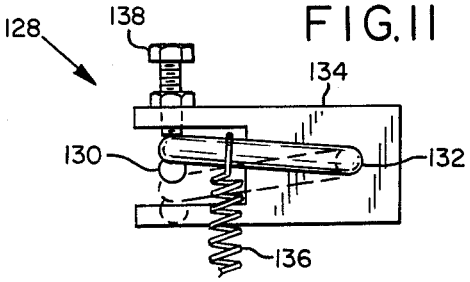
FIG. 11 is an elevational view of the dancer taken along lines 11—11 of FIG. 10.

In order to discourage the paper from unwanted movement with respect to the processing unit, yet allow the paper to be freely moved by the paper feeder and the registration station, applicant has found that it is preferable to provide a degree of resistance, analogous to the drag of a fishing reel, to movement of the paper. For this purpose a vacuum brake 120 as shown in FIGS. 2, 3, and 10 is positioned at the infeed end of the press. The vacuum brake merely consists of a sealed tube 122 having a plurality of holes 124 formed therein. Vacuum is applied to the inside of the tube and creates a suction force at the holes to provide some resistance to paper movement past the holes. A keeper arm 126 tucks the paper around the tube to maintain the paper in contact with the holes.

Applicant has also determined that it is preferable to provide a shock absorber to cushion the paper from sudden stops and starts which could tear the paper. The buffering device shown most clearly in FIGS. 2, 3, 10 and 11 is commonly called a dancer 128 in the printing trade, taking its name from its characteristic up-and-down motion while in operation. The dancer includes an elongate bar 130 extending across the paper path and resting upon the paper. Each end of the bar is bent so as to have an ear 132 extending parallel to the axis of the bar. The bar is pivotally supported at each end by blocks 134 which have bores formed therein to receive and retain the ears of the dancer. As may be seen in FIG. 11, a spring 136 urges the bar down upon the paper and a set screw 138 limits the upward pivoting of the bar.

The purpose and operation of the dancer is most readily explained with reference to FIG. 3. Movement of the paper through the press causes the disc 80 to rotate counterclockwise. Because the registration station cannot stop and register the paper until after it has been released by the paper feeder, the disc will typically advance to a position illustrated by line a'. When the finger 86 thrusts into engagement with the disc 80, it will counter rotate the disc to a position illustrated by line b'. This counter rotation of the disc backs up the paper 16, creating slack or surplus. The spring-biased dancer 128 takes up the slack as shown in FIG. 3. When the paper is reengaged by the paper feeder and released by the registration station the dancer absorbs the shock caused by the sudden movement of the paper. Without the dancer, or some other form of buffering device, this sudden movement, coupled with the slack in the paper would be likely to tear the paper.

The present invention is particularly useful to convert a pre-existing processing unit, of the type adapted to process individual sheets of paper, to process continuous form paper. As may be seen in FIGS. 1 through 4, the registration station does not need to be operatively connected to the examplary press, nor does it need to be precisely positioned with respect to the press. The registration station merely ensures that exactly one predetermined increment has been pulled through the registration station each cycle. If slightly more or slightly less than a predetermined increment has passed the registration station, the window concept described above will move the paper forward or backward accordingly, re-registering the paper to the printer each cycle. Since the paper is engaged on the pin belt, the paper cannot slip with respect to the registration station. Because the registration station is neither operatively connected nor precisely positioned with respect to the press, it may be easily and quickly bolted on and off the press. Alternatively, only that portion of the registration station which interferes with the printing of single sheets needs to be removed.

In the case of a wet offset press of the type shown in the drawings, it may not be necessary to provide a separate paper feeding station 14 as shown and explained with respect to the first embodiment of the invention since the operation of the printing blanket, blanket cylinder and impression cylinder will serve as a paper feeder to feed continuous paper in discontinuous pulses. However, it is necessary to provide timely signals to the registration station to register and hold the paper in registration, and to release the paper when the next increment of paper is fed to the press.

With other types of existing presses or processing units it may be necessary to add a separate feeding station 14 as shown in FIGS. 1, 5, 6 and 7 to feed predetermined increments of the continuous paper to the processing unit in discontinuous pulses.

Figure 5:
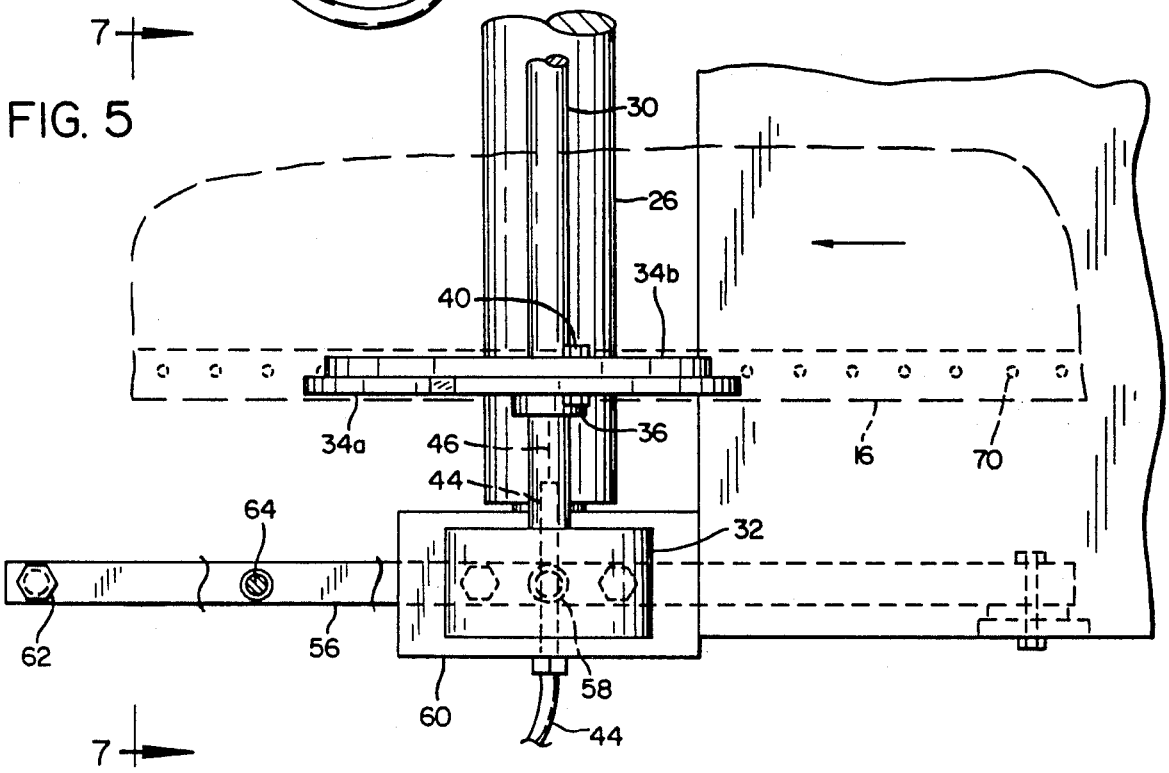
FIG. 5 is a partial plan view of the paper feeding portion of the first embodiment of the invention taken along lines 5—5 of FIG. 1 with the draw roller solenoid cut away.

The paper feeding station of the first embodiment may be installed on and removed from the exemplary printing press with little difficulty. Although the feeder shaft does need to be operatively driven off a shaft of the press, it is a relatively simple matter to modify the press by fastening an output pulley 96 on an available drive shaft as shown in FIG. 1. As with the registration station, precise placement of the paper feeding station with respect to the press is not required since it is only critical that it draw exactly one predetermined increment of paper through the press, not any particular predetermined length of paper. A paper feeding station, substantially as shown in FIGS. 5 and 6 may be fitted on to the outfeed end of the press by any suitable method such as the fasteners 98 shown in FIG. 6.

It may also be desirable to provide additional electrical control signals between the press, the registration station and the paper feeder, as well as the aforementioned control signals between the paper feeder and the registration solenoid. When beginning printing operations with an offset press, it is customary to disengage the blanket cylinder from the impression cylinder so that the blanket cylinder and the ink cylinders may be rotated to "ink up." In the case of the first embodiment, to avoid feeding paper through the press during this process when no printing is being accomplished, the press may be electrically linked to the draw roller solenoid 63 and the registration solenoid 84 to activate both solenoids during "ink up," thereby preventing the segment from drawing paper through the press and maintaining the paper in proper registry to the press.

In the case of the second embodiment as shown in FIG. 9, a press solenoid 139 is connected to a pivotable arm 140 which supports the shaft 142 of the impression cylinder 20. When this solenoid is activated it drops the impression cylinder away from the blanket cylinder so that the press will not feed or print paper. The press solenoid is controlled through a relay by a second microswitch (not shown) co-located with the first microswitch 118, to ensure that the press solenoid does not disengage the impression cylinder when the press is feeding and printing paper nor engage the impression cylinder when the registration station has the paper immobilized.

Those familiar with this art will realize that there are readily available alternatives for many of the features described and shown herein. For example, an optical scanner of the type adapted to count pin holes, a tachometer generator, or a variety of state-of-the-art motion detectors employed in conjunction with computers, may be used instead of the scanner or cams shown herein to determine when a predetermined increment has been fed to the press and so provide a signal to the registration station.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. An apparatus for successively registering continuous paper to a processing unit such as a printer or perforator, said apparatus comprising:

(a) paper engaging means for maintaining continuous engagement with said paper while allowing said paper to move with respect to processing unit;

(b) detent means for selectively interacting with said paper engaging means to cause said paper engaging means to successively register and immobilize said paper with respect to said processing unit;

(c) said paper engagement means including substantially planar low mass rotating means for rotating about an axis substantially perpendicular to said rotating means when said paper is moving with respect to said processing unit, said rotating means defining a plane and including a plurality of peripheral projections from said plane and parallel to said axis, said peripheral projections approximating a circle, said axis and any adjacent pair of said peripheral projections defining a sector of said circle, a plurality of said sectors comprising said circle said sectors being substantially free of surfaces or projections which are parallel to said axis.

2. The apparatus of claim 1 wherein said rotating means comprises a disk with peripheral posts.

3. An attachment for reverseably converting a press of the type employing a blanket cylinder and an opposed impression cylinder to feed single sheets of paper to said press and which is free of paper feeding mechanisms other than the cooperation of said blanket cylinder and said opposed impression cylinder, to a press which is capable of discontinuously feeding, printing, and successively registering continuous paper to said press, said attachment comprising:

(a) sensing means operatively associated with said blanket cylinder for determining when said blanket cylinder, in cooperation with said impression cylinder, has fed a predetermined length of said paper to said press;

(b) registration means, separate from and mechanically independent of said blanket cylinder and said sensing means, for individually, successively, indexing and immobilizing each of said predetermined lengths contained in said paper to said press;

(c) said registration means including means for selectively moving said continuous paper forward or backward with respect to said press to index said predetermined lengths of said paper to said press;

(d) electrical control means operatively associated with said sensing means and said registration means for successively causing said registration means to index each of said predetermined lengths to said press, alternately with the discontinuous feeding operation of said press; and (e) said attachment free of paper feeding means for feeding said continuous paper to said press.

4. The attachment of claim 3 wherein said registration means includes freely movable paper engaging means for maintaining continuous engagement with said paper, said paper engaging means being separate and mechanically independent from said blanket cylinder.

5. The attachment of claim 3 wherein said registration means includes low mass, freely movable paper engaging means for maintaining continuous engagement with said paper.

6. The attachment of claim 3 wherein said registration means includes:

(a) freely movable paper engaging means for maintaining continuous engagement with said paper while permitting the discontinuous feeding of said paper to said press;

(b) detent means for selectively interacting with said paper engaging means to arrest and align said paper with respect to said press; and (c) activation means for selectively causing said detent means to move to interact with said paper engaging means at a speed which is independent of and unrelated to the operating speed of said blanket cylinder.

7. The attachment of claim 3 wherein said blanket cylinder and said impression cylinder are capable of being selectively moved apart from each other so as to permit said blanket cylinder to rotate without engaging said paper, said control means including means for preventing said blanket cylinder and said impression cylinder from being moved apart when said blanket cylinder is engaging said paper.

8. The attachment of claim 3 wherein said blanket cylinder and said impression cylinder are capable of being selectively moved apart from each other and reengaged with each other so as to selectively permit said blanket cylinder to rotate without engaging said paper, said control means including means for preventing said blanket cylinder and said impression cylinder from being reengaged when said paper is immobilized by said registration means.

9. An apparatus for successively registering continuous paper to a printing press of the type employing a blanket cylinder and an opposed impression cylinder to discontinuously feed said paper to said press, said apparatus comprising:

(a) sensing means operatively associated with said blanket cylinder for determining when said blanket cylinder, in cooperation with said impression cylinder, has fed a predetermined length of said paper to said press;

(b) registration means, separate and mechanically independent of said blanket cylinder and said sensing means, for individually, successively, indexing and immobilizing each of said predetermined lengths contained in said paper to said press;

(c) said registration means including means for selectively moving said continuous paper forward or backward with respect to said press to index said predetermined lengths of said paper to said press;

(d) electrical control means operatively associated with said sensing means and said registration means for successively causing said registration means to index each of said predetermined lengths to said press, alternately with the discontinuous feeding operation of said press; and (e) said apparatus and said press being free of paper feeding means for feeding said continuous paper to said press other than the cooperation of said blanket cylinder and said impression cylinder.

10. The apparatus of claim 9 wherein said registration means includes freely movable paper engaging means for maintaining continuous engagement with said paper, said paper engaging means being separate and mechanically independent from said blanket cylinder.

11. The apparatus of claim 9 wherein said registration means includes low mass, freely movable paper engaging means for maintaining continuous engagement with said paper.

12. The apparatus of claim 9 wherein said registration means includes:

(a) freely movable paper engaging means for maintaining continuous engagement with said paper while permitting the discontinuous feeding of said paper to said press;

(b) detent means for selectively interacting with said paper engaging means to arrest and align said paper with respect to said press; and (c) activation means for selectively causing said detent means to move to interact with said paper engaging means at a speed which is independent of and unrelated to the operating speed of said blanket cylinder.

13. The apparatus of claim 9 wherein said blanket cylinder and said impression cylinder are capable of being selectively moved apart from each other so as to permit said blanket cylinder to rotate without engaging said paper, said control means including means for preventing said blanket cylinder and said impression cylinder from being moved apart when said blanket cylinder is engaging said paper.

14. The apparatus of claim 9 wherein said blanket cylinder and said impression cylinder are capable of being selectively moved apart from each other and reengaged with each other so as to selectively permit said blanket cylinder to rotate without engaging said paper, said control means including means for preventing said blanket cylinder and said impression cylinder from being reengaged when said paper is immobilized by said registration means.

* * * * *